US005520836A

United States Patent [19]

Schwadtke et al.

[11] Patent Number: 5,520,836

[45] **Date of Patent: *May 28, 1996**

[54] LIQUID DETERGENT

[75] Inventors: Karl Schwadtke, Leverkusen; Eric Sung, Monheim, both of Germany

[73] Assignee: Henkel Kommanditgesellschaft auf Aktien, Duesseldorf, Germany

[ * ] Notice: The term of this patent shall not extend beyond the expiration date of Pat. No. 5,441,662.

[21] Appl. No.: 392,425

[22] Filed: Feb. 22, 1995

Related U.S. Application Data

[63] Continuation of Ser. No. 140,146, filed as PCT/EP92/00913, Apr. 25, 1992, Pat. No. 5,441,662.

[30] Foreign Application Priority Data

May 3, 1991 [DE] Germany ..... 41 14 491.0

[51] Int. Cl.[6] ..... C11D 9/32; C11D 1/12

[52] U.S. Cl. ..... 252/108; 252/121; 252/132; 252/174.17; 252/DIG. 1; 252/173; 252/DIG. 11; 252/DIG. 14

[58] Field of Search ..... 252/108, 121, 252/132, 550, 173, 174.17, DIG. 1, DIG. 11, DIG. 14

[56] References Cited

U.S. PATENT DOCUMENTS

| | | | |
|---|---|---|---|
| 4,392,977 | 7/1983 | Altenschöpfer et al. | 252/174.19 |
| 4,539,133 | 9/1985 | Boskamp | 252/109 |
| 5,043,091 | 8/1991 | Joshi et al. | 252/174.17 |
| 5,271,860 | 12/1993 | Schwadtke et al. | 252/96 |

FOREIGN PATENT DOCUMENTS

| | | |
|---|---|---|
| 0033111 | 8/1981 | European Pat. Off. . |
| 0181041 | 5/1986 | European Pat. Off. . |
| 0403948 | 12/1990 | European Pat. Off. . |
| 3920480 | 1/1991 | Germany . |
| 2232420 | 12/1990 | United Kingdom . |

*Primary Examiner*—E. Rollins-Cross
*Assistant Examiner*—Patricia L. Hailey
*Attorney, Agent, or Firm*—Wayne C. Jaeschke; John E. Drach; Henry E. Millson, Jr.

[57] ABSTRACT

An aqueous liquid detergent comprising an anionic surfactant, a nonionic surfactant, an alkyl glucoside, a soap of an unsaturated or saturated fatty acid, a polyhydric alcohol and from about 10 to about 20% by weight of citric acid or an alkali metal salt thereof.

19 Claims, No Drawings

LIQUID DETERGENT

This is a continuation of Ser. No. 140,146, filed as PCT/EP92/00913, Apr. 25, 1992, now U.S. Pat. Ser. No. 5,441,662.

BACKGROUND OF THE INVENTION

1. Field of the Invention

Liquid detergents are an alternative to powder-form detergents, liquid detergents being understood in the following to be pourable products and products of paste-like or salve-like consistency. Compared with powder-form detergents, liquid detergents have certain handling advantages and other performance features. In particular, larger quantities of nonionic surfactants can be incorporated in liquid detergents than in powder-form detergents which has the advantage of greater effectiveness against oily and greasy soil.

2. Statement of Related Art

Liquid detergents have long been known. Nevertheless, there is a need to find further improvements in regard to detergency and the possibility of producing liquid detergents using renewable raw materials. A liquid detergent which can be universally used at washing temperatures of 15° to 90° C. and which is particularly suitable for washing delicate fabrics is known from DE-A-39 20 480. It contains anionic surfactants, nonionic surfactants, alkyl glucosides, soaps of unsaturated and saturated fatty acids, polyhydric alcohol and citric acid in certain ratios by weight. The problem addressed by the present invention was further to improve this detergent.

DESCRIPTION OF THE INVENTION

Accordingly, the present invention relates to a liquid detergent containing anionic surfactants, non-ionic surfactants, alkyl glucosides, soaps of unsaturated and saturated fatty acids, polyhydric alcohol and citric acid, the detergent according to the invention being characterized in that it contains 10 to 20% by weight citric acid. Although the liquid detergent according to DE-A-39 20 480 also contains citric acid, the citric acid content of the detergents according to DE-A-39 20 480 is very much lower, i.e. is below 2% by weight. The content of citric acid according to the invention provides for a distinct improvement in detergency over state-of-the-art detergents, so that better washing results are obtained than with the known detergent for the same dosage or even a lower dosage. On the other hand, equally good detergency can be obtained with a much smaller dose of the detergent according to the invention.

Suitable anionic surfactants for the detergents according to the invention are surfactants of the sulfonate type and particularly of the sulfate type. Suitable sulfates are sulfuric acid monoesters of $C_{12-18}$ fatty alcohols, such as for example lauryl, myristyl or cetyl alcohol, and the fatty alcohol mixtures obtained from coconut oil, palm oil and palm kernel oil which may additionally contain unsaturated alcohols, for example oleyl alcohol. Mixtures in which 50 to 70% by weight of the alkyl radicals contain 12 carbon atoms, 18 to 30% by weight 14 carbon atoms, 5 to 15% by weight 16 carbon atoms, less than 3% by weight 10 carbon atoms and less than 10% by weight 18 carbon atoms are preferably used. The percentage content of anionic surfactants in the detergents according to the invention is 3 to 10% by weight.

Nonionic surfactants in the context of the present invention are adducts of 1 to 10 mol ethylene oxide and/or propylene oxide with primary $C_{12-18}$ fatty alcohol and mixtures thereof, such as coconut oil fatty alcohol, tallow fatty alcohol or oleyl alcohol. Oxoalcohol ethoxylates are also suitable, but are less preferred because they are produced from fossil raw materials. The nonionic surfactants mentioned may be present in the detergents according to the invention in quantities of 15 to 30% by weight. This figure does not include the alkyl glucosides which also count as non-ionic surfactants.

Particularly suitable alkyl glucosides, which are also present in the liquid detergent according to the invention, are glucosides containing a $C_{5-22}$ alkyl radical, preferably an alkyl radical consisting essentially of $C_{12}$ to $C_{18}$ which is derived from lauryl, myristyl, cetyl and stearyl alcohol and from technical fractions preferably containing saturated alcohols. It is particularly preferred to use alkyl glucosides in which the alkyl component contains 50 to 70% by weight $C_{12}$ and 18 to 30% by weight $C_{14}$ The degree of oligomerization (D.P.) of the alkyl glucosides used in the detergents according to the invention is between 1.10 and 1.45.

A key constituent of the liquid detergent according to the invention is a mixture of soaps of unsaturated and saturated fatty acids. The fatty acids contain 12 to 18 carbon atoms. A preferred soap mixture consists of sodium oleate and the sodium salts of saturated $C_{12-16}$ fatty acid mixtures. The percentage content of $C_{12-14}$, fatty acids is best at least 60% by weight and preferably at least 75% by weight (expressed as fatty acid). For example, coconut oil fatty acids from which 25 the fractions containing 10 carbon atoms and less have been largely removed are suitable for this purpose. As usual with technical fatty acid cuts, the oleic acid and the coconut oil fatty acid may also contain certain amounts of stearic acid, although the percentage content of stearic acid, based on soap-forming fatty acids, should be at most 25% by weight and preferably less than 20% by weight. A soap mixture of sodium oleate and the sodium salt of lauric acid is also preferred. The ratio by weight of saturated to unsaturated fatty acid is preferably of the order of 2:1 to 1:2.

Besides water, the liquid detergents according to the invention contain at least one polyhydric alcohol as solvent. Propane-1,2-diol or, preferably, glycerol may be used as the polyhydric alcohol. In addition, the liquid detergent according to the invention may also contain monohydric alcohol, preferably ethanol.

The key feature of the liquid detergents according to the invention is their high content of citric acid or sodium citrate of 10 to 20% by weight, expressed as citric acid. Preferred liquid detergents contain 12 to 18% by weight citric acid or sodium citrate, expressed as citric acid. It was not foreseeable to the expert that a drastic improvement in the washing result would be obtained by a citric acid content several times 15 higher than in state-of-the-art detergents. Accordingly, the detergent according to the invention gives better Washing results than known detergents for the same dosage or even for a lower dosage or a comparable washing result in a much smaller dosage.

In one particular embodiment, detergents according to the invention have the following composition:

- 4 to 6% by weight anionic surfactant, preferably fatty alkyl sulfates in the form of the sodium salts,
- 18 to 28% by weight nonionic surfactant, preferably fatty alcohol ethoxylates,
- 1 to 4% by weight alkyl glucoside corresponding to the formula $RO(G)_x$, in which R is a fatty alkyl radical, G is a glucose unit and x has a value of 1.10 to 1.45, 5 to 10% by weight polyhydric alcohol, preferably glycerol, 12 to 18% by weight Na citrate, remainder water and typical detergent ingredients in small quantities.

Typical detergent ingredients are, for example, optical brighteners, enzymes, enzyme stabilizers, dyes, fragrances and complexing agents. Foam inhibitors may also be present and include, for example, organopolysiloxanes and mixtures thereof with microfine, optionally silanized silica and paraffins, waxes, microcrystalline waxes and mixtures thereof with silanized silica. Mixtures of different foam inhibitors, for example those of silicones, paraffins or waxes, may also be used with advantage.

The detergents according to the invention have a liquid to paste-like consistency at room temperature. Paste-form detergents can be produced in liquid format elevated temperature, for example at 70° C., using units for the production of liquid products. After cooling, products such as these assume a paste-like consistency which they retain in storage. For example, they may readily be expressed from tubes and show very good solubility. The constituents of the detergents according to the invention can be largely or completely produced from renewable raw materials and are readily bioldegradable.

EXAMPLES

The following washing tests were carried out with a known liquid detergent A and a detergent B according to the invention. The detergents had the following composition:

TABLE 1

| Composition of detergents % by weight | A | B |
|---|---|---|
| Coconut oil alkyl sulfate Na | 4.5 | 5.0 |
| Coconut oil alcohol + 7 mol ethylene oxide | 12.0 | 25.0 |
| $C_{12/14}$ alkyl glucoside-1.4 | 1.5 | 1.5 |
| Lauric acid Na | 8.0 | 8.0 |
| Palm kernel oil fatty acid Na | 6.0 | 6.0 |
| Glycerol | 5.0 | 7.0 |
| Citric acid | 0.5 | 15.0 |
| Sodium hydroxide | 2.6 | 1.5 |
| Ethanol | 6.0 | — |
| Protease | 0.5 | 0.05 |
| Amylase | | |
| Remainder: water, dye, fragrance, optical brightener, viscosity regulator | | |

The liquid detergent A was compared with the paste-form detergent B in a one-cycle wash program carried out at 60° C. in an automatic drum-type washing machine (AEG LAVA 670) using water with a hardness of 16. dH. Detergent A was used in a quantity of 120 g and detergent B in a quantity of 92.5 g for 18 liters washing water. Test fabrics of crease-resistant cotton and of crease-resistant polyester/cotton provided with artificial and natural soils were washed together with 3.5 kg normally soiled domestic washing. The washing result was evaluated by determining the color difference dE (w) -with a Minolta CR-200 tester. The washing results set out in Tables 2 and 3 were obtained, the color difference being represented by the complementary values to the starting value (SV), so that the higher value signifies the better washing performance.

TABLE 2

| | crease-resistant cotton | | | | | |
|---|---|---|---|---|---|---|
| To SV | Lip-stick | Make-up | Mascara | Red wine | Tea | Bilberry |
| Detergent A | 27.7 | 38.6 | 21.7 | 13.8 | 4.4 | 31.7 |
| Detergent B | 34.3 | 39.7 | 41.3 | 19.9 | 6.8 | 38.9 |

TABLE 3

| | crease-resistant polyester/cotton | | | | | |
|---|---|---|---|---|---|---|
| To SV | Lip-stick | Make-up | Mascara | Red wine | Tea | Bilberry |
| Detergent A | 8.5 | 33.4 | 26.0 | 15.9 | 4.4 | 36.4 |
| Detergent B | 13.7 | 36.5 | 32.1 | 18.5 | 5.7 | 39.6 |

In every case, detergent B according to the invention produced the better results. Even when the detergent according to the invention was used in a quantity of only 60 g as against 120 g of the known detergent, tendentially better washing results were obtained with the detergent according to the invention for all the soil types tested (sebum/pigment, enzyme-specific soils, bleachable soils and cosmetic soils).

We claim:

1. An aqueous liquid detergent comprising an anionic surfactant, a nonionic surfactant, an alkyl glucoside, a soap of an unsaturated or saturated fatty acid, a polyhydric alcohol and from about 10 to about 20% by weight of citric acid or alkali metal salt thereof.

2. The composition of claim 1 wherein the amount of citric acid is from about 12 to about 18% by weight.

3. The composition of claim 1 wherein said polyhydric alcohol is glycerol.

4. The composition of claim 1 wherein said anionic surfactant is the sodium salt of a fatty alkyl sulfate.

5. The composition of claim 4 wherein the amount of said sodium salt of a fatty alkyl sulfate is from about 4 to about 6% by weight.

6. The composition of claim 1 wherein said nonionic surfactant is a fatty alcohol ethoxylate.

7. The composition of claim 6 wherein the amount of said fatty alcohol ethoxylate is from about 15 to about 30% by weight.

8. The composition of claim 1 wherein said alkyl glucoside has the formula $RO(G)_x$, wherein R is an alkyl radical, G is a glucose unit and x has a value of 1.10 to 1.45.

9. The composition of claim 8 wherein the amount of said alkyl glucoside is from about 1 to about 4% by weight.

10. The composition of claim 9 wherein the amount of said polyhydric alcohol is from about 5 to about 10% by weight.

11. The composition of claim 1 wherein the anionic surfactant is present in from about 3 to about 10% by weight; and the nonionic surfactant is present in from about 15 to about 30% by weight.

12. The composition of claim 11 wherein the alkyl glucoside is present in from about 1 to about 4% by weight.

13. The composition of claim 11 wherein the amount of citric acid is from about 12 to about 18% by weight.

14. The composition of claim 11 wherein the alkyl glucoside is present in from about 1 to about 4% by weight; the polyhydric alcohol is present in from about 5 to about 10% by weight; and the amount of citric acid is present in from about 12 to about 18% by weight.

15. The composition of claim 1 wherein the polyhydric alcohol is present in from about 5 to about 10% by weight.

16. The composition of claim 1 wherein the soap of an unsaturated or saturated fatty acid contains from 12 to 18 carbon atoms.

17. The composition of claim 1 wherein the soap of a unsaturated or saturated fatty acid is a soap mixture of sodium oleate and the sodium salts of saturated $C_{12-16}$ fatty acid mixtures.

18. The composition of claim 17 wherein said soap mixture contains at least about 60% by weight of $C_{12-14}$ fatty acids.

19. An aqueous liquid detergent comprising:

A. from about 3 to about 10% by weight of an anionic surfactant;

B. from about 15 to about 30% by weight of a nonionic surfactant other than an alkyl glucoside;

C. from about 1 to about 4% by weight of an alkyl glucoside;

D. a soap of an unsaturated and/or saturated fatty acid;

E. from about 5 to about 10% by weight of a polyhydric alcohol; and

F. from about 10 to about 20% by weight of citric acid or an alkali metal salt thereof.

* * * * *